US009737751B2

(12) United States Patent
Anderson

(10) Patent No.: US 9,737,751 B2
(45) Date of Patent: Aug. 22, 2017

(54) BODYWEIGHT EXERCISE APPARATUS AND SYSTEM

(71) Applicant: Reed Anderson, Sandy, UT (US)

(72) Inventor: Reed Anderson, Sandy, UT (US)

( * ) Notice: Subject to any disclaimer, the term of this patent is extended or adjusted under 35 U.S.C. 154(b) by 0 days.

(21) Appl. No.: 14/962,940

(22) Filed: Dec. 8, 2015

(65) Prior Publication Data

US 2017/0157450 A1 Jun. 8, 2017

(51) Int. Cl.

| | |
|---|---|
| ***A63B 21/068*** | (2006.01) |
| ***A63B 21/16*** | (2006.01) |
| ***A63B 69/00*** | (2006.01) |
| ***A63B 41/00*** | (2006.01) |
| ***A63B 21/00*** | (2006.01) |

(52) U.S. Cl.

CPC ..... *A63B 21/16* (2013.01); *A63B 21/4034* (2015.10); *A63B 21/4035* (2015.10); *A63B 41/00* (2013.01); *A63B 69/0057* (2013.01)

(58) Field of Classification Search

CPC ..... A63B 21/00069; A63B 21/00072; A63B 21/00076; A63B 21/00185; A63B 21/06; A63B 21/0601; A63B 21/0602; A63B 21/0615; A63B 21/0616; A63B 21/065; A63B 21/068; A63B 21/08; A63B 21/16; A63B 21/169; A63B 21/4017; A63B 21/4019; A63B 21/4021; A63B 21/4023; A63B 21/4025; A63B 21/4029; A63B 21/4033; A63B 21/4035; A63B 21/4039; A63B 23/0205; A63B 23/0211; A63B 23/0216; A63B 23/0222; A63B 23/0233; A63B 23/12; A63B 23/1209; A63B 23/1218; A63B 23/1227; A63B 23/1236; A63B 23/1245; A63B 23/1281; A63B 26/00; A63B 26/003; A63B 41/00; A63B 69/0057; A63B 69/0059; A63B 69/0073; A63B 69/0075; A63B 2069/0062; A63B 2208/0214; A63B 2208/0242; A63B 2208/0257; A63B 2208/0261; A63B 2208/0285; A63B 2208/029; A63B 2208/0295; A63B 2225/62

See application file for complete search history.

(56) References Cited

U.S. PATENT DOCUMENTS 4,126,326 A * 11/1978 Phillips ..... B62K 9/00 280/205
4,620,701 A * 11/1986 Mojden ..... A63B 3/00 482/142
5,302,164 A * 4/1994 Austin ..... A63B 21/0023 482/39

(Continued)

*Primary Examiner* — Loan H Thanh
*Assistant Examiner* — Gary D Urbiel Goldner
(74) *Attorney, Agent, or Firm* — Kunzler Law Group, PC

(57) ABSTRACT

A bodyweight exercise apparatus includes a tower assembly, at least one handle coupleable to the tower assembly, and an exercise ball retainer. A user may grasp the at least one handle to perform one or more bodyweight exercises. The exercise ball retainer may be configured to receive an exercise ball in roll-inhibiting engagement and may be configured to support the exercise ball in a spotting position relative to the at least one handle. With the exercise ball in the spotting position, the user is able to customize and/or modify the one or more bodyweight exercises, thus facilitating the proper performance of the one or more bodyweight exercises.

19 Claims, 12 Drawing Sheets

(56) References Cited

U.S. PATENT DOCUMENTS 5,372,556 A 12/1994 Ropp
5,407,404 A 4/1995 Killian et al.
D401,985 S * 12/1998 Wheeler ..... D21/686
6,217,483 B1 * 4/2001 Kallassy ..... A63B 21/068 482/38
6,461,284 B1 * 10/2002 Francavilla ..... A61H 1/0218 482/121
6,478,721 B1 * 11/2002 Hunter ..... A63B 21/0085 482/140
6,547,706 B1 * 4/2003 Chek ..... A63B 21/02 482/132
D476,705 S * 7/2003 Dillard ..... D21/662
6,689,026 B2 * 2/2004 Almada ..... A63B 23/0211 446/220
6,746,372 B2 6/2004 Hsu
7,147,591 B2 * 12/2006 McAvoy ..... A63B 1/00 482/148
7,691,036 B1 * 4/2010 Julian ..... A61H 1/0292 482/110
7,819,781 B1 * 10/2010 Maldonado ..... A63B 21/00047 482/130
D634,375 S * 3/2011 Usrey ..... D21/662
7,931,575 B2 4/2011 Rochford
D638,888 S * 5/2011 Maldonado ..... D21/662
8,152,703 B1 4/2012 Hinds et al.
8,425,383 B1 * 4/2013 Kelly ..... A63B 69/0057 482/121
8,696,532 B1 4/2014 Peterson
9,248,336 B2 * 2/2016 Deis ..... A63B 21/15
9,415,276 B1 * 8/2016 Hao ..... A63B 41/00
2003/0036467 A1 * 2/2003 Almada ..... A63B 23/0211 482/140
2003/0083178 A1 * 5/2003 Gilman ..... A63B 21/055 482/92
2003/0195098 A1 * 10/2003 Hsu ..... A47C 9/002 482/148
2005/0079964 A1 * 4/2005 Francavilla ..... A63B 23/0233 482/142
2006/0063653 A1 * 3/2006 Wickens ..... A63B 41/00 482/142
2007/0117682 A1 * 5/2007 Deola ..... A63B 21/015 482/51
2008/0058184 A1 * 3/2008 Hale ..... A63B 21/015 482/142
2008/0128463 A1 * 6/2008 Bryan ..... A63B 21/00047 224/486
2008/0176727 A1 * 7/2008 Heitzman ..... A47C 4/54 482/142
2008/0261789 A1 * 10/2008 Hsu ..... A63B 23/03575 482/140
2010/0267526 A1 * 10/2010 Baschnagel ..... A63B 21/026 482/86
2010/0331154 A1 * 12/2010 Taylor ..... A63B 26/003 482/142
2011/0028291 A1 * 2/2011 Signorile ..... A63B 26/003 482/142
2011/0111934 A1 * 5/2011 Taylor ..... A63B 26/003 482/139
2011/0124476 A1 * 5/2011 Holley ..... A63B 23/02 482/121
2011/0183827 A1 * 7/2011 Radi ..... A63B 21/00047 482/140
2011/0237412 A1 * 9/2011 Signorile ..... A63B 26/003 482/142
2012/0028765 A1 * 2/2012 Morin ..... A61H 15/00 482/91
2012/0329626 A1 12/2012 Meredith et al.
2013/0239326 A1 * 9/2013 Boggiano ..... A47G 27/0237 5/417
2015/0031514 A1 * 1/2015 Deis ..... A63B 21/15 482/142
2016/0089564 A1 * 3/2016 Archer ..... A63B 69/0057 482/140

* cited by examiner

BODYWEIGHT EXERCISE APPARATUS AND SYSTEM

FIELD

This invention relates to exercise equipment and more particularly relates to bodyweight exercise devices.

BACKGROUND

There are many different types of exercise equipment that people use to perform different exercises. For example, people may use free weights, resistance bands, and/or weight machines to perform exercises in order to build strength, lose weight, burn fat, and increase stamina, among other benefits. Additionally, many people participate in bodyweight exercises, such as pull-ups and push-ups. Bodyweight exercises are workouts where the person's body weight provides, or at least contributes to, the resistance of the workout. However, conventional bodyweight exercises may be difficult for certain users to perform (at least initially) due to insufficient muscle strength, improper positioning, and/or a lack of options for modifying bodyweight exercises.

SUMMARY

From the foregoing discussion, it should be apparent that a need exists for an apparatus and system that facilitate a user's ability to perform bodyweight exercises. Beneficially, such an apparatus and system would allow the user to customize and/or modify bodyweight exercises based on the user's strength or preference. The subject matter of the present application has been developed in response to the present state of the art, and in particular, in response to the problems and needs in the art that have not yet been fully solved by currently available exercise devices. Accordingly, the present disclosure has been developed to provide an apparatus and system that overcome many or all of the above-discussed shortcomings in the art.

Disclosed herein is one embodiment of a bodyweight exercise apparatus. The bodyweight exercise apparatus includes a tower assembly, at least one handle coupleable to the tower assembly, and an exercise ball retainer. A user may grasp the at least one handle to perform one or more bodyweight exercises and the exercise ball retainer may be configured to receive an exercise ball in roll-inhibiting engagement and may be configured to support the exercise ball in a spotting position relative to the at least one handle. With the exercise ball in the spotting position, the user is able to customize and/or modify the bodyweight exercises, thus facilitating the proper performance of the one or more bodyweight exercises.

In one implementation, the at least one handle is adjustably coupleable to the tower assembly. For example, a vertical position of the at least one handle may be adjustable. In another example, the at least one handle has two corresponding handles and a lateral spacing between the two corresponding handles is adjustable. In another implementation, the exercise ball retainer is configured to support the exercise ball in a plurality of spotting positions. For example, the plurality of spotting positions may be predetermined positions.

In one implementation, the bodyweight exercise apparatus further includes a support base, with the tower assembly being coupleable to the support base. In one implementation, the exercise ball retainer may be removably coupleable to the support base. For example, the exercise ball retainer may include magnets that are configured to magnetically couple the exercise ball retainer to the support base, pins that are configured to engage corresponding holes in the support base, or other removable attachment mechanisms. In another implementation, the exercise ball retainer may be integrally formed in the support base. For example, exercise ball retainer may be an indentation recess formed in the support base. Further, the support base may include one or more wheels that facilitate moving the apparatus to a new location.

In one implementation, the tower assembly is made from a single column, with the at least one handle having two corresponding support arms extending outward from the tower assembly in a mirror image configuration. For example, the tower assembly may be positionable adjacent to an acute corner of a room and an angle between extension directions of the two corresponding support arms extending outward from the tower assembly may be less than or equal to 90 degrees.

In another implementation, the at least one handle comprises a first and a second set of handles. One set of handles may include a pull-up unit and the other, second set of handles may include a dip unit. In one example, one or more of the at least one handle is detachable from the tower assembly.

Also disclosed herein is one embodiment of an bodyweight exercise system that includes a support base, a tower assembly coupleable to the support base, at least one handle coupleable to the tower assembly, and an exercise ball positionable relative to the at least one handle in a spotting position. The user may grasp the at least one handle to perform one or more bodyweight exercises and the exercise ball may facilitate performance of the one or more bodyweight exercises. In one implementation, the system further includes an exercise ball retainer that is configured to support the exercise ball in roll-inhibiting engagement.

Disclosed herein is one embodiment of a bodyweight exercise apparatus. The bodyweight exercise apparatus includes a support base, a tower assembly coupleable to the support base, at least one handle coupleable to the tower assembly, and an exercise ball retainer coupleable to the support base. The user may grasp the at least one handle to perform one or more bodyweight exercises and the exercise ball retainer may be configured to receive an exercise ball in roll-inhibiting engagement and may be configured to support the exercise ball in a spotting position relative to the at least one handle, wherein the exercise ball in the spotting position facilitates performance of the one or more bodyweight exercises. In one implementation, the apparatus further includes an exercise ball.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. These features and advantages of the present disclosure will become more fully apparent from the following description and appended claims, or may be learned by the practice of the disclosure as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the subject matter of the present application will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Furthermore, the described features, structures, or characteristics of the disclosure may be combined in any suitable manner in one or more embodiments. In the following description, numerous specific details are provided. One skilled in the relevant art will recognize, however, that the subject matter of the present application may be practiced without one or more of the specific details, or with other methods, components, materials, and so forth. In other instances, well-known structures, materials, or operations are not shown or described in detail to avoid obscuring aspects of the disclosure.

Figure 1A:
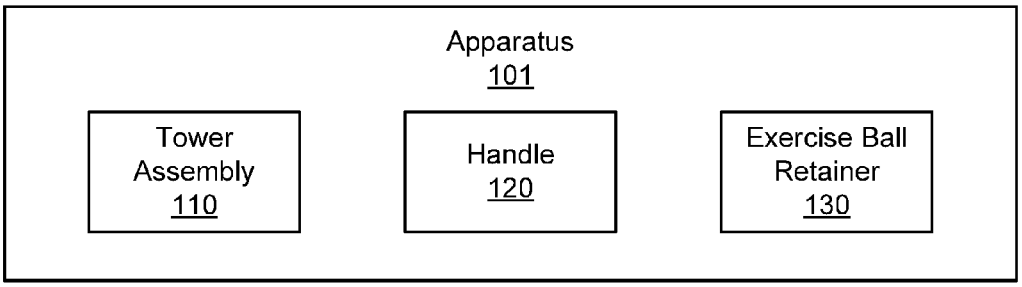
FIG. 1A is a schematic block diagram of a bodyweight exercise apparatus, according to one embodiment.
Figure 1B:
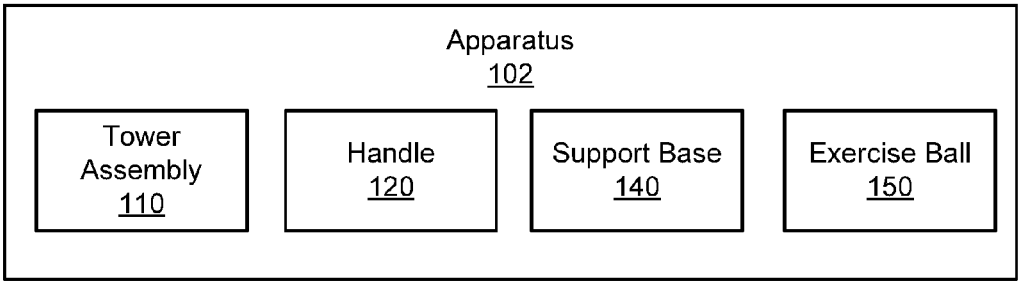
FIG. 1B is a schematic block diagram of a bodyweight exercise apparatus, according to another embodiment.
Figure 1C:
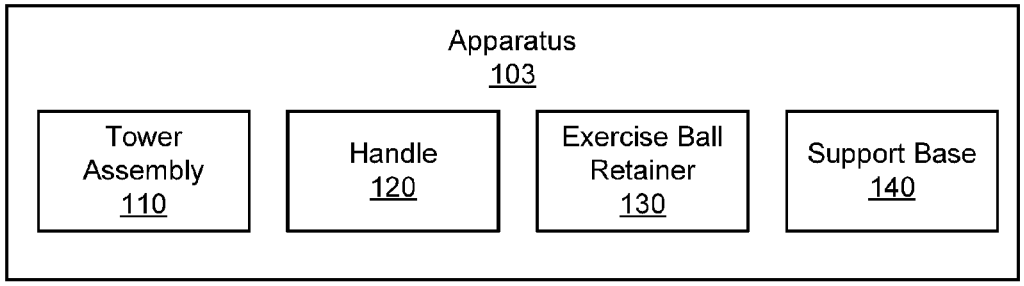
FIG. 1C is a schematic block diagram of a bodyweight exercise apparatus, according to yet another embodiment.

FIGS. 1A-1C are schematic block diagrams of various embodiments of a bodyweight exercise apparatus. Each of these figures shows a plurality of components that may be implemented as the bodyweight exercise apparatus. The three different embodiments of the apparatus 101, 102, 103 depicted in FIGS. 1A-1C are not exhaustive lists of the possible combinations of components that may be implemented to form the bodyweight exercise apparatus. In other words, additional components or different combinations of components may be incorporated in other embodiments of the bodyweight exercise apparatus.

FIG. 1A depicts a bodyweight exercise apparatus 101 that includes a tower assembly 110, at least one handle 120, and an exercise ball retainer 130. FIG. 1B depicts another embodiment of the bodyweight exercise apparatus 102 that includes the tower assembly 110, the at least one handle 120, a support base 140, an exercise ball 150. FIG. 1C depicts yet another embodiment of the bodyweight exercise apparatus 103 that includes the tower assembly 110, the at least one handle 120, the exercise ball retainer 130, and the support base 140. These components 110, 120, 130, 140, 150 are described in detail below with reference to various embodiments shown in the remaining figures. Throughout the present disclosure, like numbers refer to like elements/components.

Figure 2:
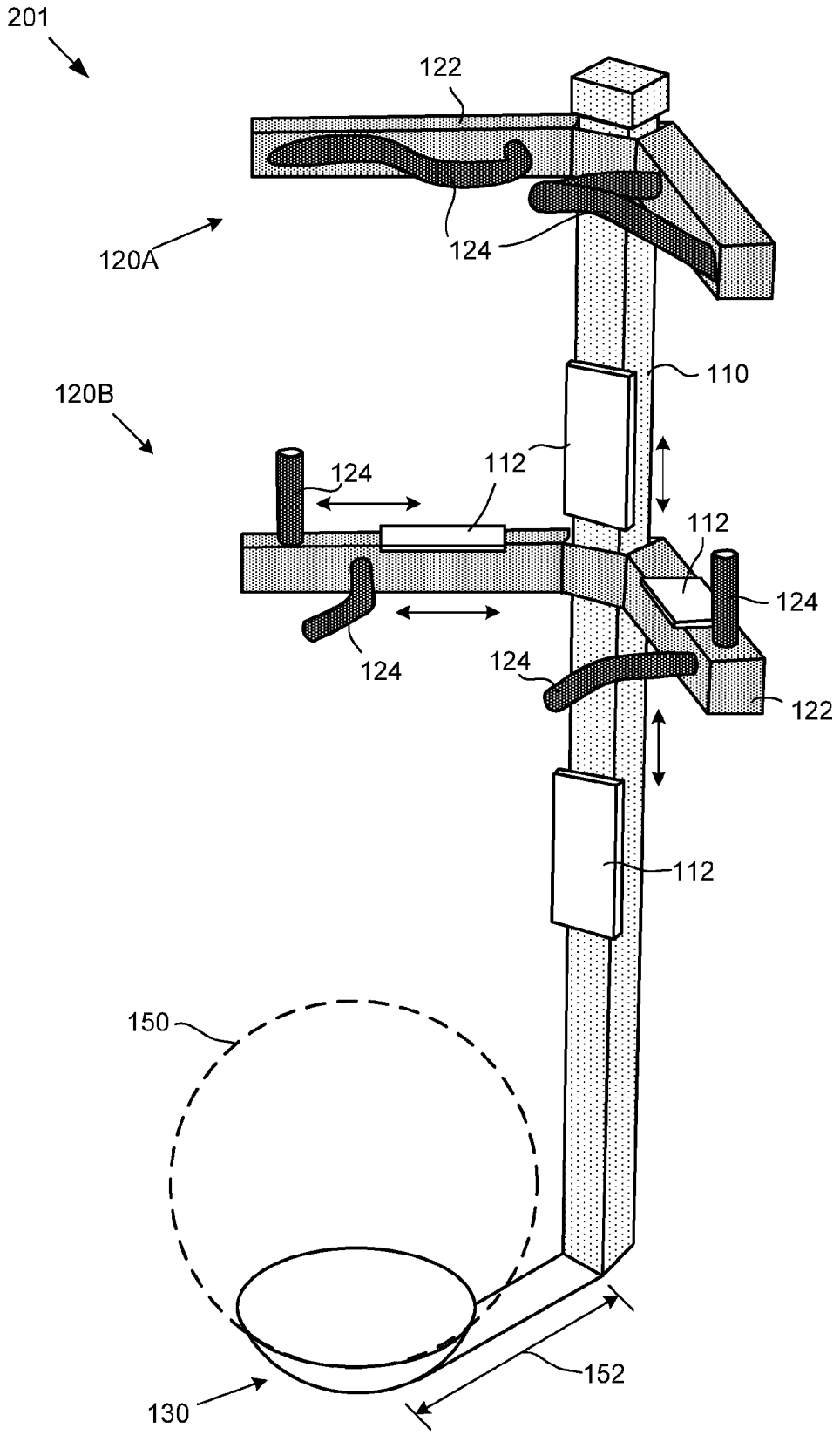
FIG. 2 is a schematic perspective view of a bodyweight exercise apparatus that includes a tower assembly, at least one handle, and an exercise ball retainer, according to one embodiment.

FIG. 2 is a schematic perspective view of a bodyweight exercise apparatus 201 that includes a tower assembly 110, at least one handle 120A, 120B (collectively "120"), and an exercise ball retainer 130, according to one embodiment. Generally, the bodyweight exercise apparatus facilitates a user's ability to perform bodyweight exercises. More specifically, a user may place an exercise ball 150 into engagement with the exercise ball retainer 130 and may utilize the exercise ball 150 as a spotter in performing various bodyweight exercises. For example, a user may utilize the bodyweight exercise apparatus 201 to perform modified/assisted pull-ups, push-ups, dips, leg curls, etc. Details relating to how users can perform various bodyweight exercises while using the bodyweight exercise apparatus are included below with reference to FIGS. 6-9.

The tower assembly 110 is an elongate member that extends substantially vertically and to which the at least one handle 120 is coupled. In one embodiment, the tower assembly 110 may be a single unitary beam. The tower assembly 110 may be permanently integrated and anchored to an environment. For example, the tower assembly 110 may be bolted/welded to a wall of a building. In another embodiment, the tower assembly 110 may be anchored to the ground using a cement foundation or other similar anchoring means. In another embodiment, as described below, the tower assembly 110 may be portable to allow user to move and reposition the bodyweight exercise apparatus 201. The tower assembly 110, in one embodiment, may be collapsible/extendable to allow user to adjust the height and/or position of the tower assembly 110.

In one embodiment, the tower assembly 110 may be constructed from a metallic material, a composite material, wood, etc. The cross-sectional shape of the tower assembly 110 may be rectangular, as depicted in FIG. 2, or the tower assembly 110 may have other cross-sectional shapes (circular, elliptical, triangular, etc.). In one embodiment, the tower assembly 110 is made from I-beams or other similar construction members. The bodyweight exercise apparatus 201 may also include one or more pads 112 disposed on the tower assembly 110 or on the at least one handle 120. In one embodiment, the pads 112 may be permanently coupled to or formed integrally with the tower assembly 110 or the at least one handle 120. In another embodiment, the pads 112 may be detachably or movably coupled to the tower simply 110 with at least one handle 120, thus allowing a user to position the pads 112 in orientations that improve the comfort of performing the bodyweight exercises and/or decrease the likelihood of injury.

In one embodiment, as depicted in FIG. 2, the bodyweight exercise apparatus 201 may include multiple handle units, such as a top handle 120A and a bottom handle 120B. In one embodiment, the top handle 120A may be used for pull-up and other lift-type exercises and the bottom handle 120B may be used for dips, push-ups, and other similar exercises. In another embodiment, the bodyweight exercise apparatus 201 may include three or more handle units. As used herein, the term "handle" or "handle unit" refers generally to the one or more components that extend outward from the tower assembly 110 to which the user's may hold/grasp in performing the bodyweight exercises. For example, in one embodiment the at least one handle 120 may be a simple bar or beam that is coupled to the tower assembly 110 the user can grasp in order to perform the bodyweight exercises.

In one embodiment, the at least one handle 120 extends outward in two directions from the tower assembly 110. In one embodiment, an angle between the two extension directions is less than 180°. In another embodiment, the angle between the two extension directions of the at least one handle 120 is about 90°. In such an embodiment, the bodyweight exercise apparatus 201 may be positionable in a corner of a room, thus enabling the bodyweight exercise apparatus 212 occupy less space in the room. In one embodiment, the at least one handle 120 may not only be movably coupled to the tower simply 110, but the at least one handle 120 may be completely detachable, thus allowing a user to swap between several different handle units.

In another embodiment, the each handle 120A, 120B may include a support arm 122 and one or more corresponding hand-grips 124. The support arm 122 is coupled to (or at least coupleable to) the tower assembly 110 and extends outward from the tower assembly 110 (e.g., extends substantially horizontally the ground) and the hand-grips 124 are coupled to the support arm 122. In one embodiment, the one or more hand-grips 124 may be permanently mounted to support arms 122. In another embodiment, the one or more hand-grips 124 may be detachably or movably coupled to the support arms 122, thus allowing a user to customize the position and/or orientation of the one or more hand-grips 124 with respect to the support arms 122. In another embodiment, the one or more hand-grips 124 may be rotatable or pivotable to further allow customization by the user.

For example, a user may pull and/or remove a pin or another locking mechanism, which locks and/or removably fixes a position of one or more hand-grips 124 relative to a support arm 122, and the user may rotate and/or pivot one or more hand-grips 124 and/or a hand-grip 124 assembly relative to a support arm 122, after which the user may reengage the pin or other locking mechanism to lock and/or fix the one or more hand-grips 124 in a different position relative to the support arm 122 (e.g., a rotated and/or pivoted position). As depicted in FIG. 2, the shape, design, extension direction, and dimensions of the one or more hand-grips 124 may vary according to the specifics of a certain application.

The at least one handle 120 may be constructed from a metallic material, a composite material, wood, etc. The cross-sectional shape of the support arms 122 of the handles 120A, 120B may be rectangular, as depicted in FIG. 2, or the support arms 122 110 may have other cross-sectional shapes (circular, elliptical, triangular, etc.). In one embodiment, the support arms 122 have an I-beam cross-section or other similar configuration. The hand-grips 124 may be constructed from a metallic material, a composite material, wood, etc. As mentioned above, the number, size, and dimensions, and extension direction of the at least one handle 120 may vary according to the specifics of a given application.

The exercise ball retainer 130 is configured to receive an exercise ball 150 in roll-inhibiting engagement and to support the exercise ball 150 in a spotting position 152 relative to the at least one handle 120. In other words, the exercise ball retainer 130 receives an exercise ball 150 and prevents, or at least reduces the likelihood of, the exercise ball 150 from rolling away from the tower assembly 110. Therefore, users are able to perform modified/assisted bodyweight exercises by sitting or resting a portion of a user's bodyweight on the exercise ball 150 that is retained by the exercise ball retainer 130 in a spotting position. The term "spotting position" 152 refers generally to the position of the exercise ball 150 engaged in the exercise ball retainer 130 relative to the tower assembly 110.

Generally, the exercise ball retainer 130 includes a receiving structure that prevents or at least mitigates the inadvertent rolling of the exercise ball. In one embodiment, the receiving structure of the exercise ball retainer 130 may include a spherical notch, a concave indentation, a partial recess, or a bowl-shaped element, among other structures, that passively receives the exercise ball 150 in form-fitting engagement. In another embodiment, the receiving structure of the exercise ball retainer 130 may include straps, belts, clamps, clips, or other fasteners that actively receive and hold the exercise ball 150 in secure engagement.

The exercise ball retainer 130 may coupleable to the tower assembly 110. In other words, the exercise ball retainer 130 may be permanently coupled to the tower assembly 110 in a fixed position. For example, in one embodiment the exercise ball retainer 130 is integrated into a support base that is coupled to the tower assembly 110 (see below with reference to FIGS. 4 and 5). In another embodiment, the exercise ball retainer 130 movably coupled to the tower assembly 110, thus allowing a user to change and/or customize the spotting position. In a further embodiment, the exercise ball retainer 130 is detachably coupled to the tower assembly 110. In other words, the use of the term "coupleable" with reference to the exercise ball retainer 130 and the tower assembly 110 herein denotes the relative spatial association of the tower assembly 110 and the exercise ball retainer 130 relative to each other. Thus, the exercise ball retainer 130 is positioned in, or at least positionable in, one or more predefined orientations relative to the tower assembly 110.

The exercise ball retainer 130 may further include a shaft or other element that extends between the receiving structure of the exercise ball retainer 130 and the tower assembly 110. In such an embodiment, the length and/or extension direction of the shaft that is inter-coupled between the receiving structure of the exercise ball retainer 130 and the towers assembly 110 may be customizable based on the user's preferences or based on the bodyweight exercise that the user wishes to perform. In other words, manipulation of the shaft may allow the user to change the spotting position 152 of the exercise ball retainer 130.

In another embodiment, the exercise ball retainer 130 may have a bottom surface that includes one or more elements that are configured to engage a ground surface. For example, the exercise ball retainer 130 may include one or more magnets that facilitate holding the exercise ball retainer 130 in a desired spotting position 152 via magnetic attraction to metallic/magnetic base/ground surface. In another embodiment, the exercise ball retainer 130 may have a bottom surface that includes a non-slip rubber coating or adhesive strips, among others, that facilitate holding the exercise ball retainer 130 in the spotting position.

Figure 3A:
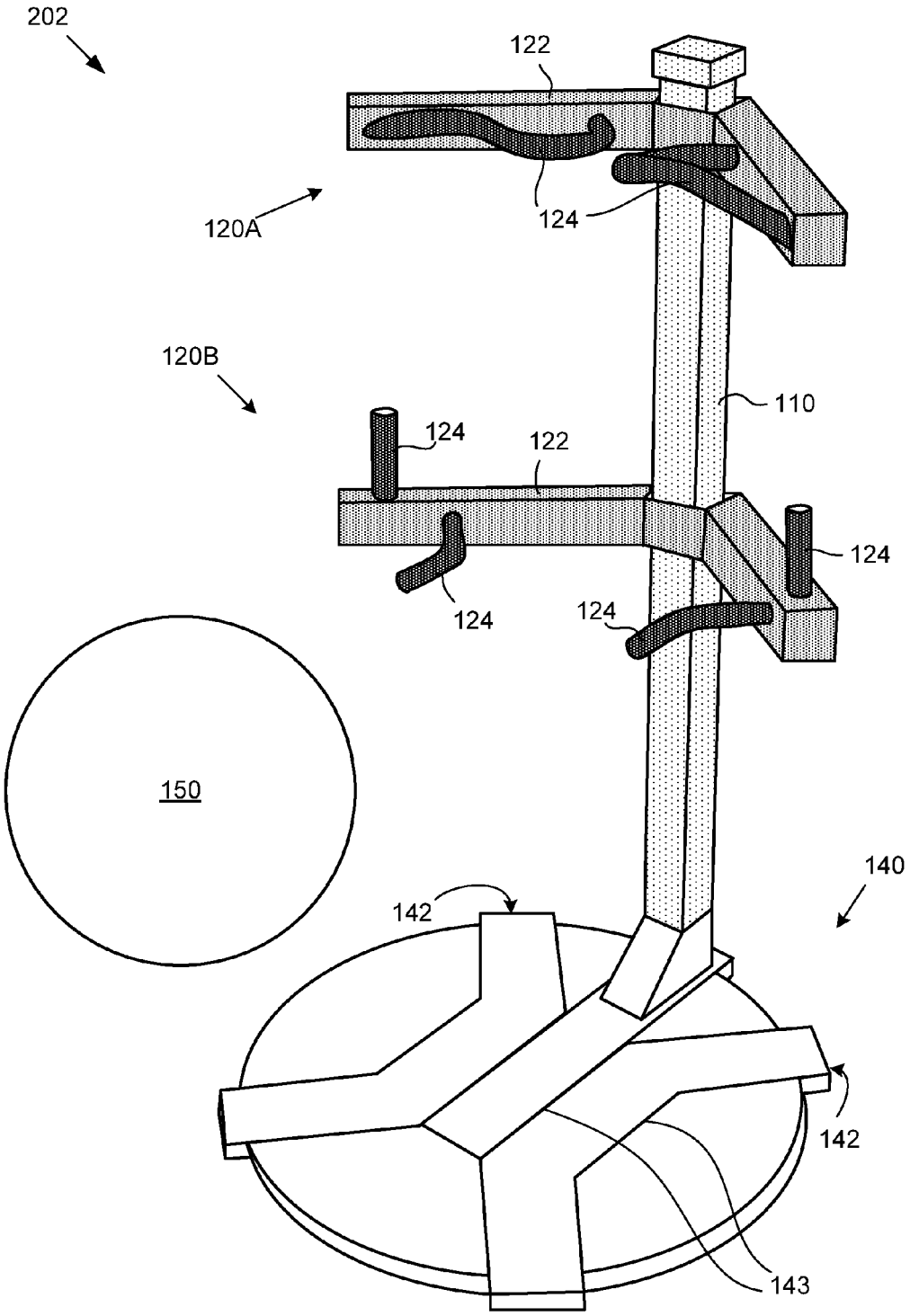
FIG. 3A is a schematic perspective view of a bodyweight exercise apparatus that includes a tower assembly, at least one handle, a support base, and an exercise ball, according to one embodiment.

FIG. 3A is a schematic perspective view of a bodyweight exercise apparatus 202 that includes the tower assembly 110, the at least one handle 120, a support base 140, and an exercise ball 150, according to one embodiment. As mentioned above, the bodyweight exercise apparatus 202 may be configured to be portable/movable across a ground surface, thus allowing a user to move and reorient the bodyweight exercise apparatus 202. Accordingly, the support base 140 may impart stability to the apparatus 202 and/or may function as a surface over which the user may perform the bodyweight exercises.

The tower assembly 110 may be coupled to the support base 140. In one embodiment, the tower assembly 110 is detachably coupled to the support base 140. In another embodiment, the tower assembly 110 is permanently coupled to the support base 140. The support base 140 may be made from a material that is similar to the tower assembly 110 or the at least one handle 120. In one embodiment the support base 140 may be permanently anchored to a ground surface (e.g. floor of a room). In one embodiment the support base 140 includes wheels or casters that enable the user to reposition and reorient the apparatus 202. The support base 140 may also include wall engagement features 142 that are configured to engage walls of the room, thereby contributing to stabilization of the bodyweight exercise apparatus 202. For example, as mentioned above, the bodyweight exercise apparatus 202 may be positioned in a corner of the room the wall engagement features 142 may engage the two walls that extend from the corner of the room. In such an embodiment, the wall engagement features 142 may include planar surfaces that are perpendicular to each other.

In one embodiment, the shape of the support base 140 may be circular, rectangular, square, or other shape. The support base 140 may include surface designs or surface features 143 that allow the user to reference his position with respect to the tower assembly 110 and/or at least one handle 120. In other words, the surface designs and surface features 143 of the support base 140 may help the user employ proper form in performing the bodyweight exercises and/or may help the user perform uniform and consistent exercise repetitions by allowing the user to visually reference his position or the position of one or more of his body parts relative to the surface features 143 of the support base 140. For example, the support base 140 may include X-shaped features 143 that are integrated or embedded within the support base 140 (see FIG. 3) that visually divide the support base 140 into various quadrants/sections. These quadrants/sections may be referenced by the user in performing the bodyweight exercises in order to further allow the user to customize and modify the bodyweight exercises.

Figure 3B:
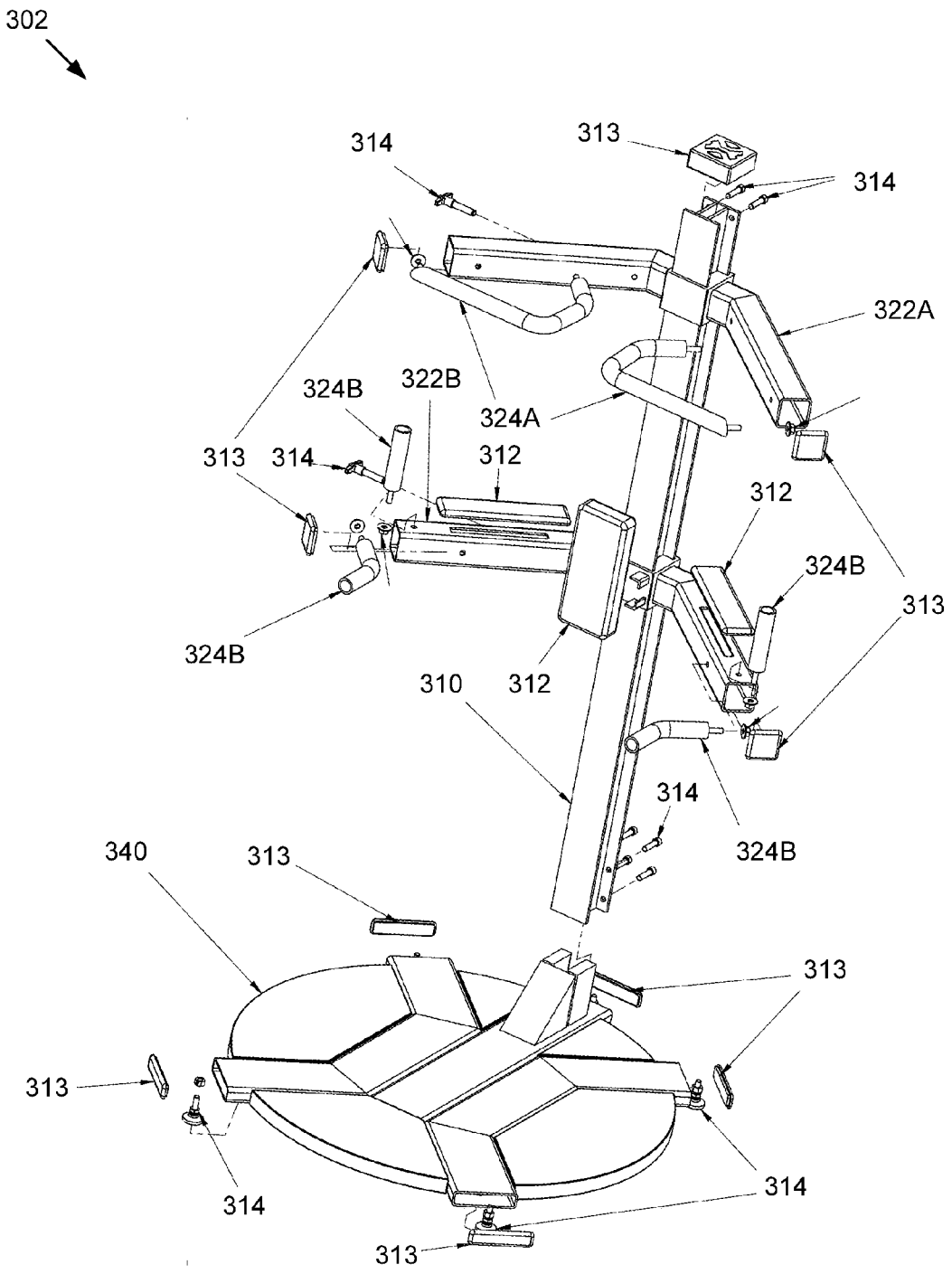
FIG. 3B is an exploded perspective view of the bodyweight exercise apparatus of FIG. 3A, according to one embodiment.

FIG. 3B is an exploded perspective view of the bodyweight exercise apparatus 302 of FIG. 3A, according to one embodiment. As mentioned above, the tower assembly 310 may have an I-beam cross-section and the at least one handle may include two separate handle units that each have support arms 322A, 322B and one or more hand-grips 324A, 324B. The one or more hand-grips 324A, 324B may be coupled to the support arms 322A, 322B using fasteners 314. The support arms 322A, 322B may be secured in respective fixed positions to the tower assembly 310 and may be utilized by the user in performing different types of bodyweight exercises. In another embodiment, one or both of the support arms 322A, 322B may be slidably coupled to the tower assembly 310, thus allowing the user to customize the position of the support arms 322A, 322B. one example, the top support arm 322A may be fixed relative to the tower assembly 310 and the bottom support arm 322B may be slidably coupled to the tower assembly 310.

As mentioned above, the bodyweight exercise apparatus 302 may include one or more pads 312 that are coupled to the tower assembly 310 or the support arms 322A, 322B. for example, in one embodiment one or more pads 312 may be coupled to a front surface of the tower assembly 310. In another embodiment, one or more pads 312 may be coupled to a top surface of one or more of the support arms 322A, 322B. Also, the bodyweight exercise apparatus 302 may include end-caps 313 that attach to and/or cover the ends of the support arms 322A, 322B, the top end of the tower assembly 310, or various ends of the support base 340. The end-caps 313 may be coupled to the respective ends using fasteners 314 or may utilize a resistive fit configuration to engage the respective ends.

Figure 4:
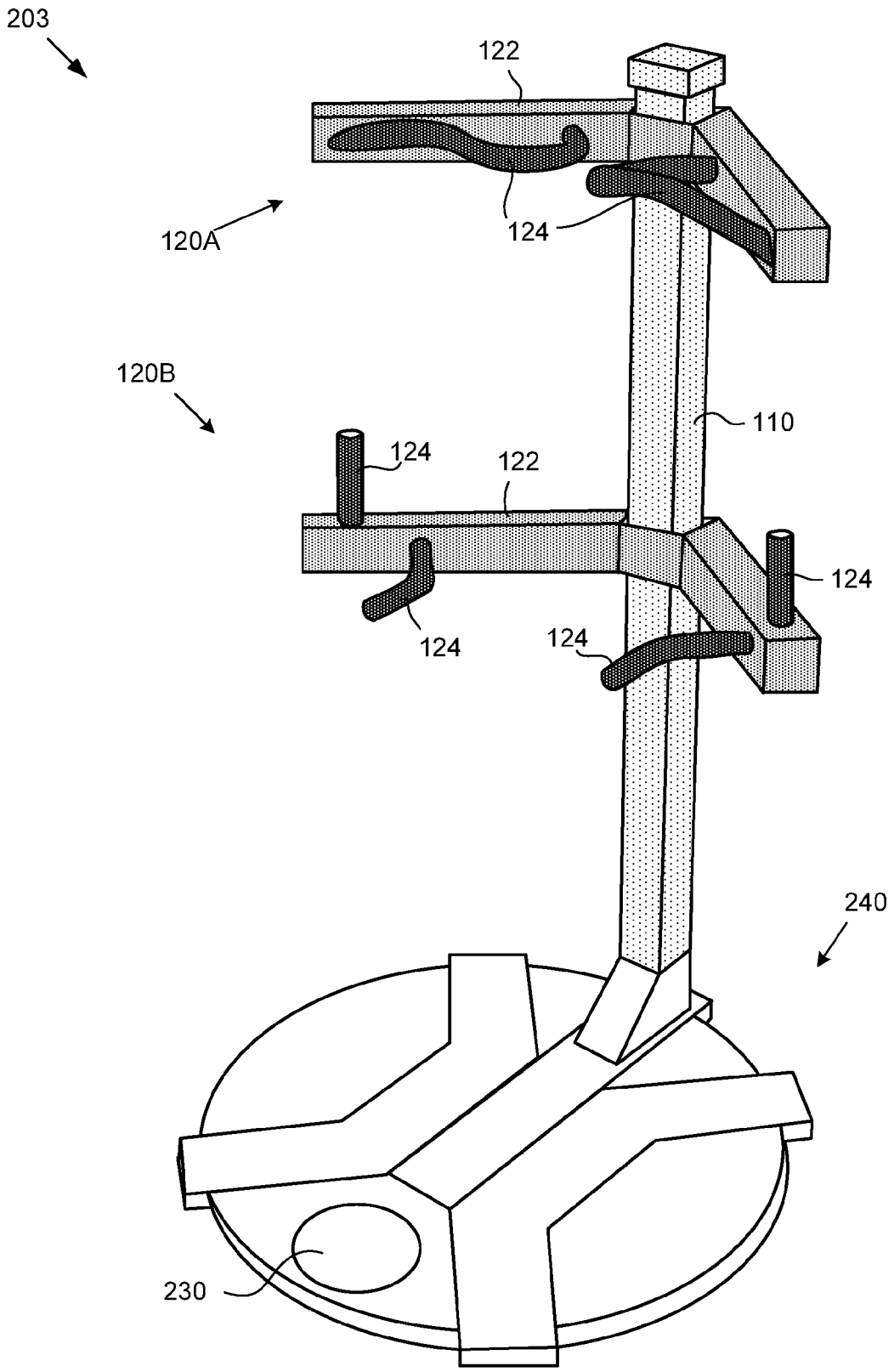
FIG. 4 is a schematic perspective view of a bodyweight exercise apparatus that includes a tower assembly, at least one handle, and a support base with an integrated exercise ball retainer, according to one embodiment.

FIG. 4 is a schematic perspective view of the bodyweight exercise apparatus 203 that includes the tower assembly 110, the at least one handle 120, and the support base 240 with an integrated exercise ball retainer 230, according to one embodiment. As mentioned above, the support base 240 may have a receiving structure of an exercise ball retainer 230 that is integrated into the support base 240. Once again, the receiving structure of the exercise ball retainer 230 may include a spherical notch, a concave indentation, a partial recess, a spherical divot, or a bowl-shaped element, among other structures, that passively receives the exercise ball 150 in form-fitting engagement. In another embodiment, the receiving structure of the exercise ball retainer 230 may include straps, belts, clamps, clips, or other fasteners that actively receive and hold the exercise ball 150 in secure engagement.

Figure 5:
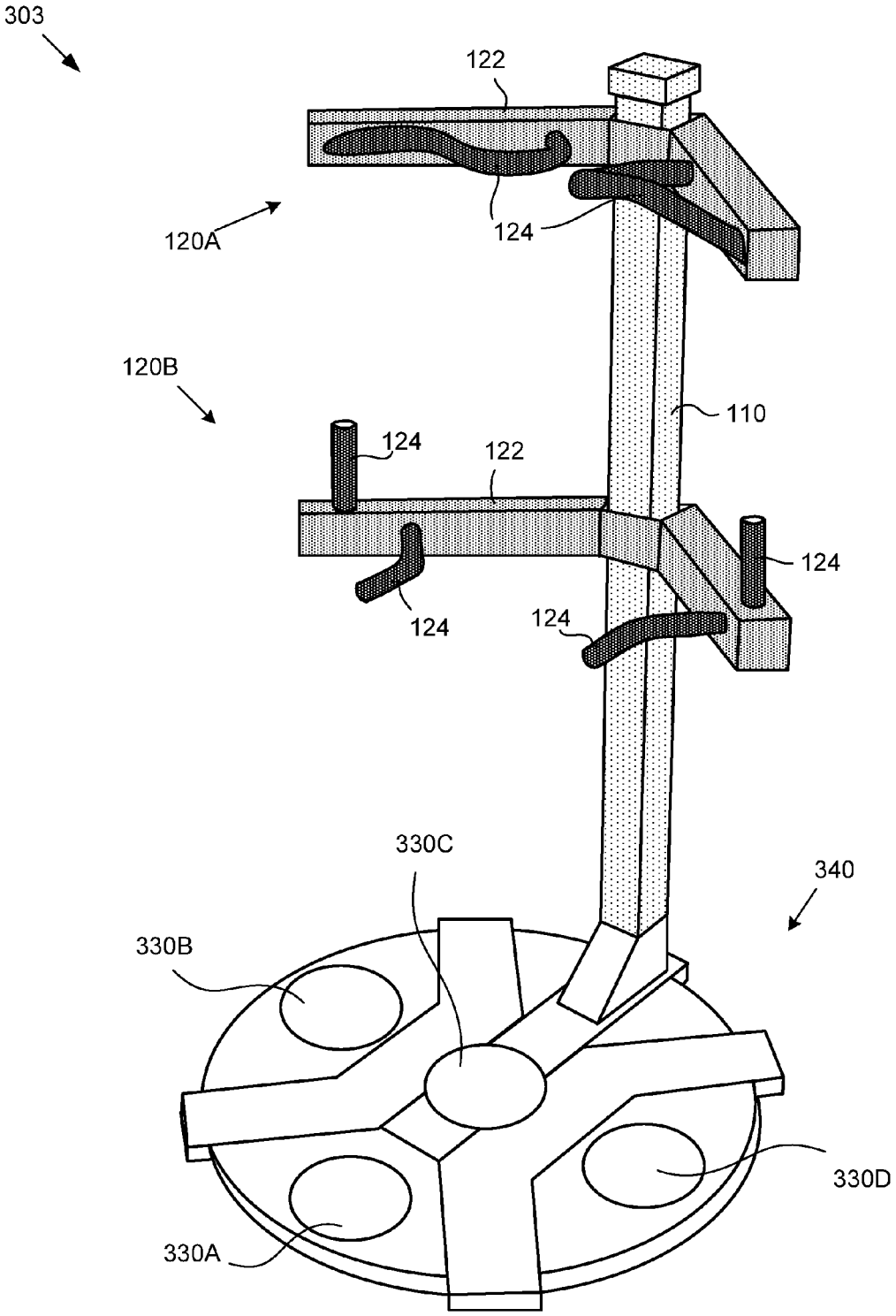
FIG. 5 is a schematic perspective view of a bodyweight exercise apparatus that includes a tower assembly, at least one handle, and a support base with a plurality of exercise ball retainers, according to one embodiment.

FIG. 5 is a schematic perspective view of the bodyweight exercise apparatus 303 that includes the tower assembly 110, at least one handle 120, and the support base 340 with a plurality of exercise ball retainers 330A, 330B, 330C, 330D, according to one embodiment. These exercise ball retainers 330A, 330B, 330C, 330D are described below with reference to FIGS. 6-9. Generally, the plurality of exercise ball retainers 330A, 330B, 330C, 330D allow the user to select where the exercise ball 150 will be retained with respect to the support base 340. Depending where the exercise ball is positioned (i.e., the spotting position), the user may perform different types of bodyweight exercises.

Figure 7:
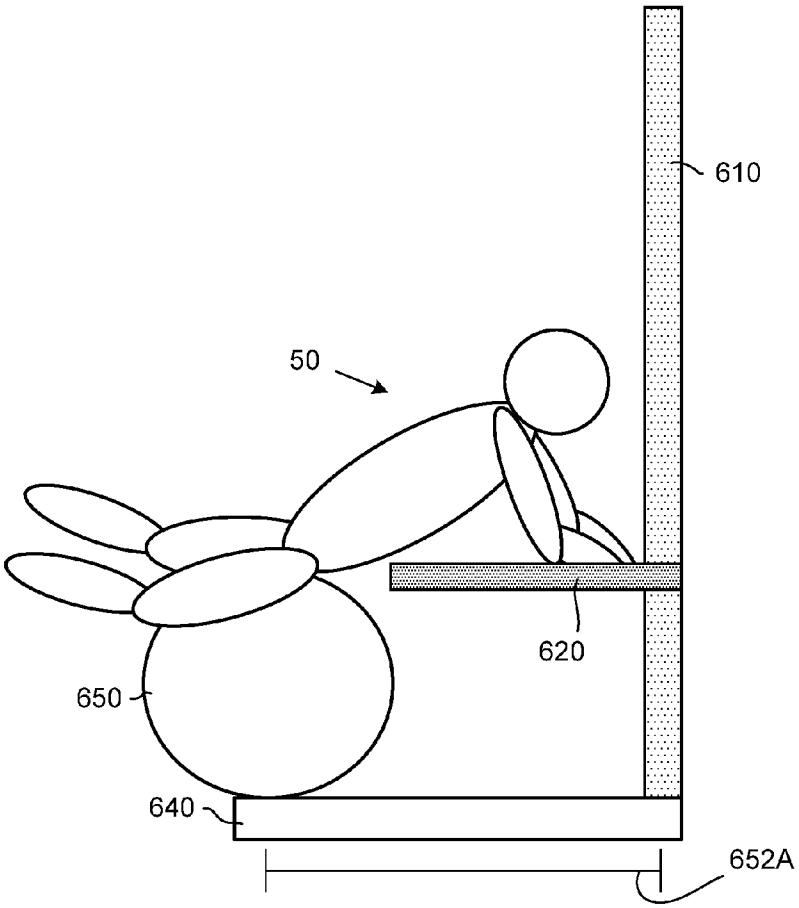
FIG. 7 is a schematic side view of a bodyweight exercise apparatus showing a user performing a bodyweight exercise with an exercise ball positioned a distance away from the tower assembly, according to one embodiment.
Figure 6:
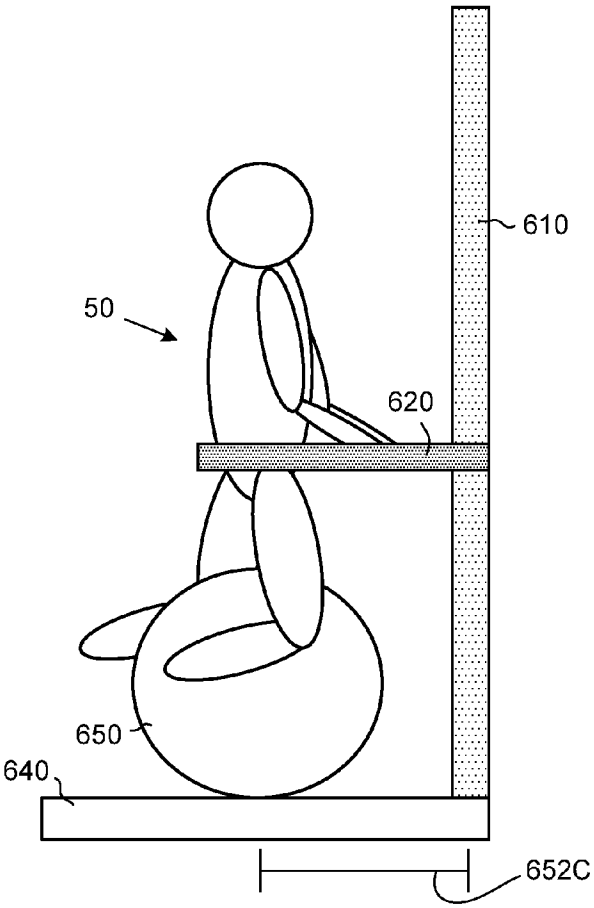
FIG. 6 is a schematic side view of a bodyweight exercise apparatus showing a user performing a bodyweight exercise with an exercise ball directly below the user, according to one embodiment.
Figure 9:
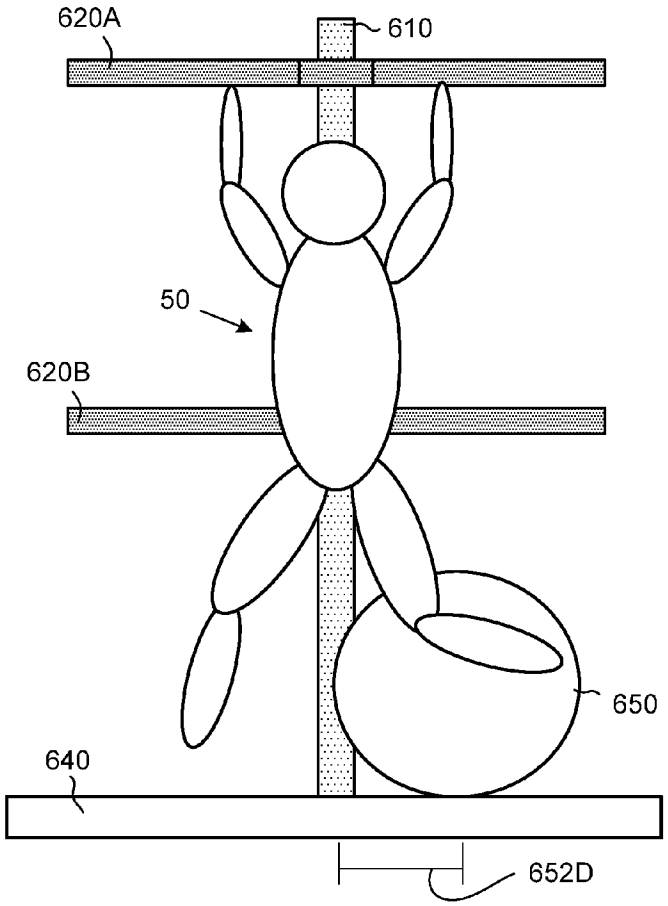
FIG. 9 is a schematic front view of a bodyweight exercise apparatus showing a user performing a bodyweight exercise with an exercise ball positioned in the second lateral spotting position, according to one embodiment.
Figure 8:
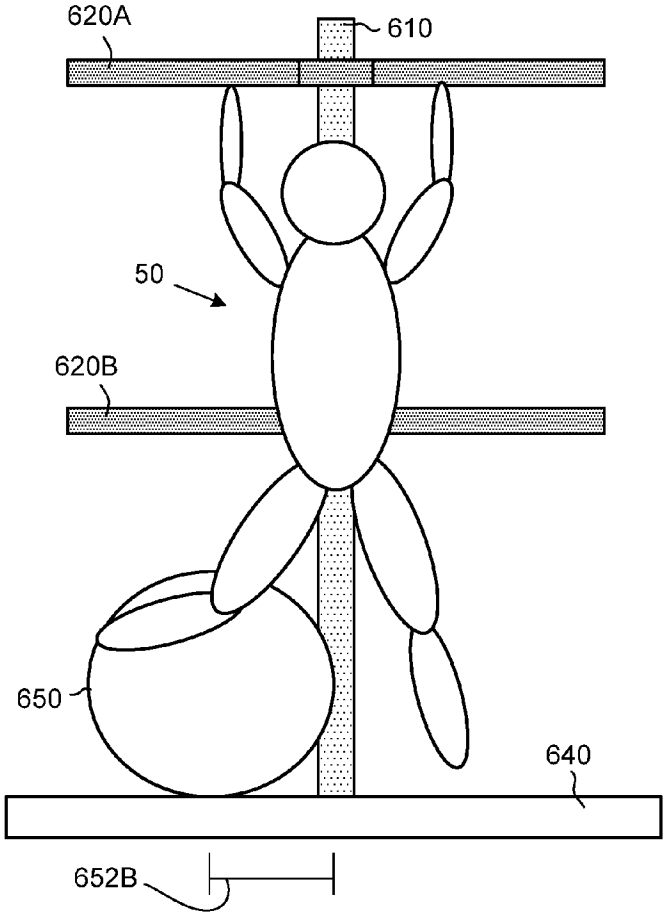
FIG. 8 is a schematic front view of a bodyweight exercise apparatus showing a user performing a bodyweight exercise with an exercise ball positioned in a first lateral spotting position, according to one embodiment.

FIG. 6-9 show schematic views of the bodyweight exercise apparatus with the user 50 performing different types of bodyweight exercises that correspond with various spotting positions 652A, 652B, 652C, 652D of the exercise ball 650. More specifically, FIG. 6 is a schematic side view of one embodiment of the bodyweight exercise apparatus showing the user 50 performing a bodyweight exercise with the exercise ball 650 in a central spotting position 652C directly below the user 50. FIG. 7 is a schematic side view of the bodyweight exercise apparatus showing the user 50 performing a bodyweight exercise with an exercise ball 650 positioned in an extended spotting position 652A that is a distance away from the tower assembly 610. FIG. 8 is a schematic front view of the bodyweight exercise apparatus showing the user 50 performing a bodyweight exercise with the exercise ball 650 positioned in a first lateral spotting position 652B. FIG. 9 is a schematic front view of the bodyweight exercise apparatus showing the user 50 performing a bodyweight exercise with the exercise ball 650 positioned in the second lateral spotting position 652D.

In one embodiment, the central spotting position 652C of the exercise ball 650 shown in FIG. 6 may correspond with the exercise ball retainer 330C shown in FIG. 5. Similarly, the extended spotting position 652A in FIG. 7, the first lateral spotting position 652B in FIG. 8, and the second lateral spotting position 652D in FIG. 9 may correspond with the exercise ball retainers 330A, 330B, 330D, respectively, shown in FIG. 5. In another embodiment, the spotting positions 652A, 652B, 652C, 652D of the exercise ball 650 in FIGS. 6-9 may not be retained within the exercise ball retainer component (i.e., the support base 140 does not have an integrated exercise ball retainer) and instead the exercise ball 650 may be free to roll across the support base 640. In a further embodiment, the exercise ball 650 may include internal weighting material, such as sand, or the exercise ball 650 may have magnets internally that hinder rolling movement of the exercise ball 650 across the support base 640. Thus, while in one embodiment the exercise ball 650 may be retained in predetermined, discrete spotting positions 652A, 652B, 652C, 652D by discrete exercise ball retainers 330A, 330B, 330C, 330D, in another embodiment the exercise ball may be freely positioned across a ground surface or across a support base 640.

While the embodiments of the bodyweight exercise apparatus shown in FIGS. 6 and 7 only show one handle unit 620, it is expected that one or more handle units may also be included and coupled to the tower assembly 610. Further, while the handles 620 in FIGS. 6-9 are only shown as simple bars extending from the tower assembly 610, it is expected that the handles 620 may include one or more hand-grips and that the handles 620 may be configured and implemented according to the details disclosed above regarding the at least one handle 120. In other words, the various components 610, 620, 640 of the bodyweight exercise apparatus shown in FIG. 6-9 are only schematic representations and such representations are included and described herein in order to clearly show various examples of bodyweight exercises that may be performed using the bodyweight exercise apparatus.

As shown in FIG. 6, one example of a bodyweight exercise that may be performed by the user 50 while utilizing the bodyweight exercise apparatus is a dip. During such an exercise, the user 50 may place the exercise ball 650 directly below himself (e.g., with the exercise ball 650 in the central spotting position 652C) and the user 50 may position himself over the exercise ball 650 while grasping the at least one handle 620. The user 50 may then proceed to exercise his arms, shoulders, chest, back, core, etc. by exerting a force on the at least one handle 620 to lift his body. The user 50 may modify the intensity of the exercise and the amount of resistance by choosing the portion and extent of his bodyweight that is supported by the exercise ball 650.

FIG. 7 shows another example of the bodyweight exercise that may be performed by the user 50 while utilizing the bodyweight exercise apparatus. In such an example, the user 50 may perform a push-up exercise by placing the exercise ball 650 in the extended spotting position 652A and by positioning his feet, his knees, his pelvis, or his stomach on the exercise ball 650 while grasping the at least one handle 620. The user 50 may then proceed to exercise his arms, chest, shoulders, back, etc. by exerting force on the at least one handle 620 to lift his body. Once again, the user 50 can modify the intensity of the exercise by choosing the portion and extent of his bodyweight that is supported by the exercise ball 650.

FIG. 8 shows another example of the bodyweight exercise that may be performed by the user 50 while utilizing the bodyweight exercise apparatus. In such an example, the user 50 may perform a first pull-up type exercise by placing the exercise ball 650 in the first lateral spotting position 652B and by positioning one of his feet or one of his knees on the exercise ball 650 while grasping the top handle 620A. The user 50 may then proceed to exercise his arms, chest, shoulders, back, etc. by exerting a pulling force on the top handle 620A to lift his body. Once again, the user 50 can modify the intensity of the exercise by choosing the portion and extent of his bodyweight that is supported by the exercise ball 650.

FIG. 9 shows yet another example of the bodyweight exercise that may be performed by the user 50 while utilizing the bodyweight exercise apparatus. In such an example, the user 50 may perform a second pull-up type exercise by placing the exercise ball 650 in the second lateral spotting position 652D and by positioning the other of his feet or the other of his knees on the exercise ball 650 while grasping the top handle 620A. The user 50 may then proceed to exercise his arms, chest, shoulders, back, etc. by exerting a pulling force on the top handle 620A to lift his body. Once again, the user 50 can modify the intensity of the exercise by choosing the portion and extent of his bodyweight that is supported by the exercise ball 650.

Figure 10:
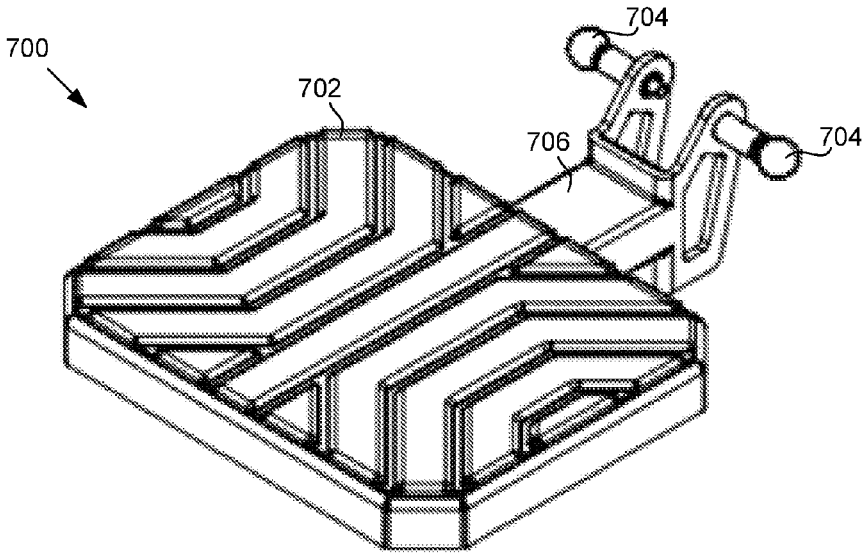
FIG. 10 is a schematic perspective view of a step platform of a bodyweight exercise apparatus, according to one embodiment.
Figure 11A:
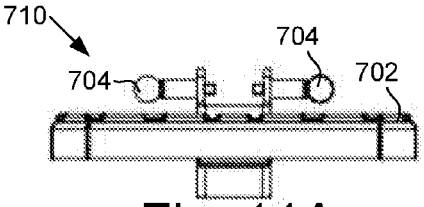
FIG. 11A is a schematic front view of a step platform of a bodyweight exercise apparatus, according to one embodiment.
Figure 11B:
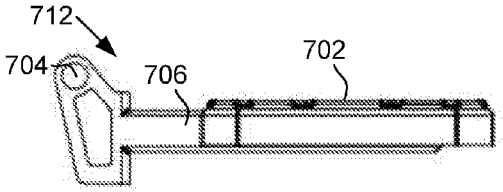
FIG. 11B is a schematic side view of a step platform of a bodyweight exercise apparatus, according to one embodiment.
Figure 11C:
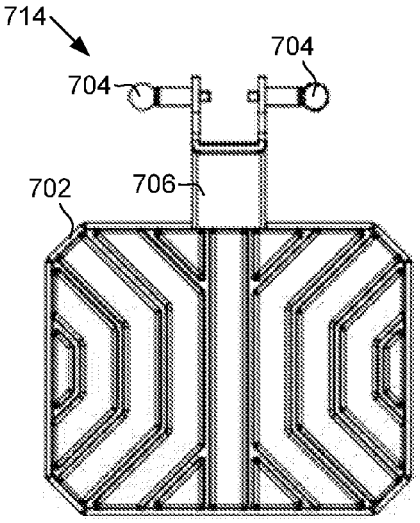
FIG. 11C is a schematic top view of a step platform of a bodyweight exercise apparatus, according to one embodiment.
Figure 11D:
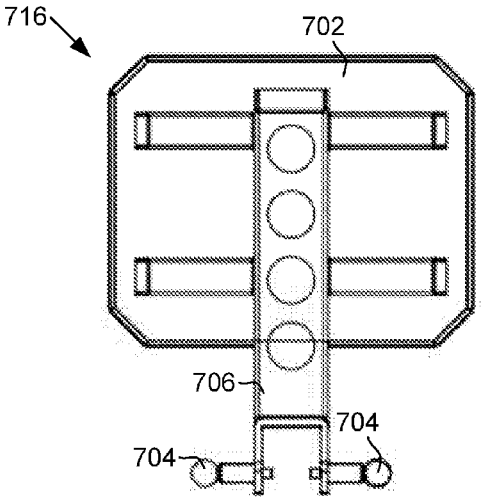
FIG. 11D is a schematic bottom view of a step platform of a bodyweight exercise apparatus, according to one embodiment.

FIG. 10 shows a perspective view 700 of one embodiment of a step platform 702 for a bodyweight exercise apparatus. In general, the step platform 702 may allow a user 50 to perform one or more exercises using the bodyweight exercise apparatus. For example, a user 50 may step onto and off of the step platform 702; may sit or place their hands on the step platform 702 with their legs extended onto an exercise ball 150, onto the support base 140, onto the floor, or the like to perform a dip or similar exercise; or the like.

In the depicted embodiment, the step platform 702 comprises one or more locking mechanisms 704 (e.g., one or more removable mechanisms such as pins, clips, hooks, brackets, screws, bolts, or the like; one or more permanent and/or semi-permanent mechanisms such as welds, adhesives, joints; or the like) configured to removably, permanently, and/or semi-permanently couple the step platform 702 to the tower assembly 110. The step platform, in certain embodiments, comprises one or more support members 706 (e.g., beams, bars, walls, tubes, pipes, poles, or the like), extending from the one or more locking mechanisms 704 to provide mechanical support for the step platform 702 and/or for a user 50 using the step platform 702. The one or more locking mechanisms 704 and/or the one or more support beams 706 may be configured to support the step platform 702 in a fixed position (e.g., perpendicular, at a predefined angle, or the like) relative to the tower assembly 110, even when supporting the body weight of a user 50.

The one or more locking mechanisms 704, the one or more support beams 706, and/or one or more other portions of the step platform 702 may comprise a durable material, such as a metallic material, a composite material, wood, or the like. In the depicted embodiment, the step platform 702 comprises a tread on an upper surface of the step platform 702 to prevent and/or minimize slipping of a user 50, while stepping on or otherwise using the step platform 702.

FIGS. 11A, 11B, 11C, and 11D depict additional views 710, 712, 714, 716 of a step platform 702 of a bodyweight exercise apparatus, according to various embodiments. The step platform 702 of FIGS. 11A, 11B, 11C, and 11D, in certain embodiments, may be substantially similar to the step platform 702 described above with regard to FIG. 10.

Figure 12C:
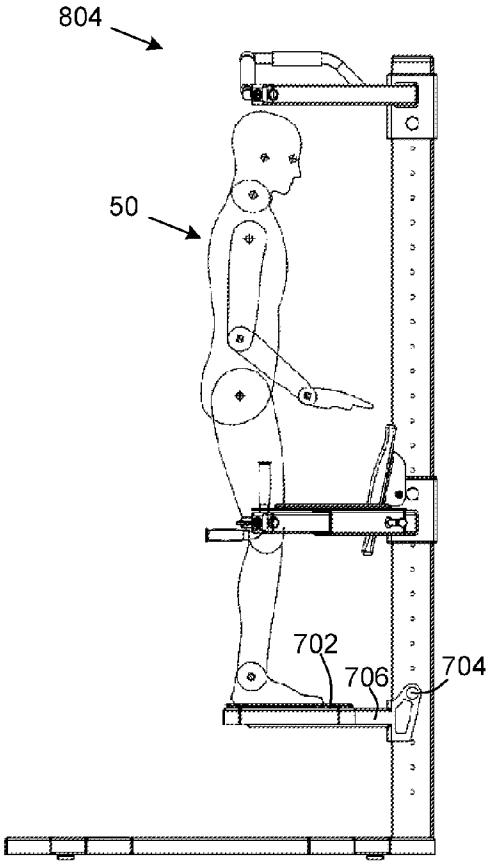
FIG. 12C is a schematic side view of a bodyweight exercise apparatus showing a user performing an exercise using a step platform, according to one embodiment.
Figure 12B:
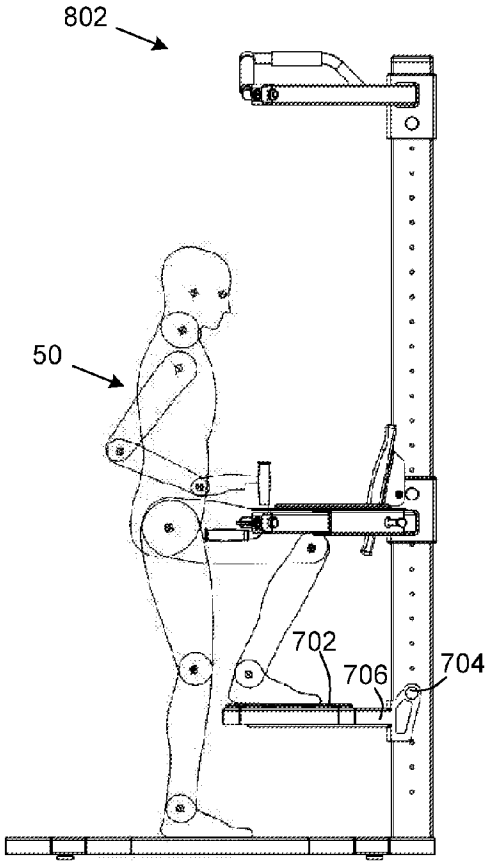
FIG. 12B is a schematic side view of a bodyweight exercise apparatus showing a user performing an exercise using a step platform, according to one embodiment.
Figure 12A:
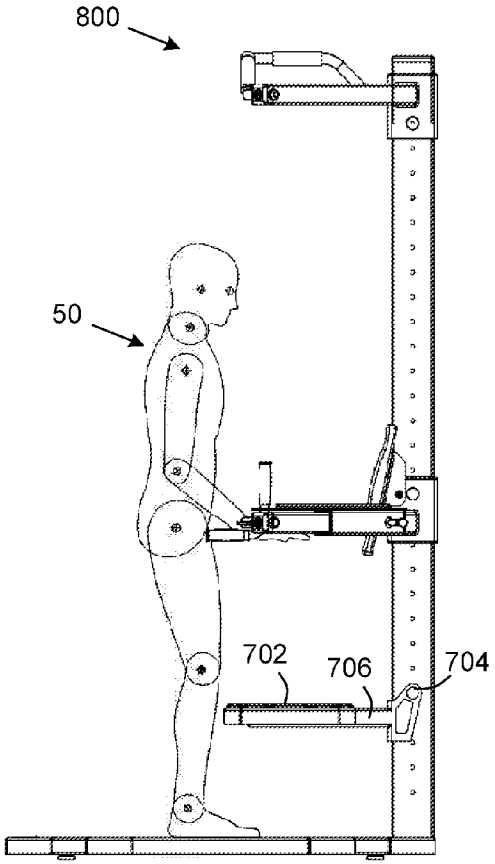
FIG. 12A is a schematic side view of a bodyweight exercise apparatus showing a user performing an exercise using a step platform, according to one embodiment.

FIGS. 12A, 12B, and 12C depict various steps 800, 802, 804 of a user 50 performing an exercise using a step platform 702. In the depicted embodiments, the step platform 702 is adjustably couplable to the tower assembly 110, such that the height of the step platform 702 is selectable and/or configurable by a user 50.

In the step 800 of FIG. 12A, the user 50 stands in front of the step platform 702 and the associated bodyweight exercise apparatus. The user 50, in certain embodiments, may grip one or more handles of the bodyweight exercise apparatus.

In the step 802 of FIG. 12B, the user 50 places one foot onto the step platform 702 to step onto the step platform 702. In the step 804 of FIG. 12C, the user 50 has stepped onto the step platform 702 with both feet. The user 50 may step off of the step platform 702 and repeat the process multiple times for additional exercise.

Figure 13:
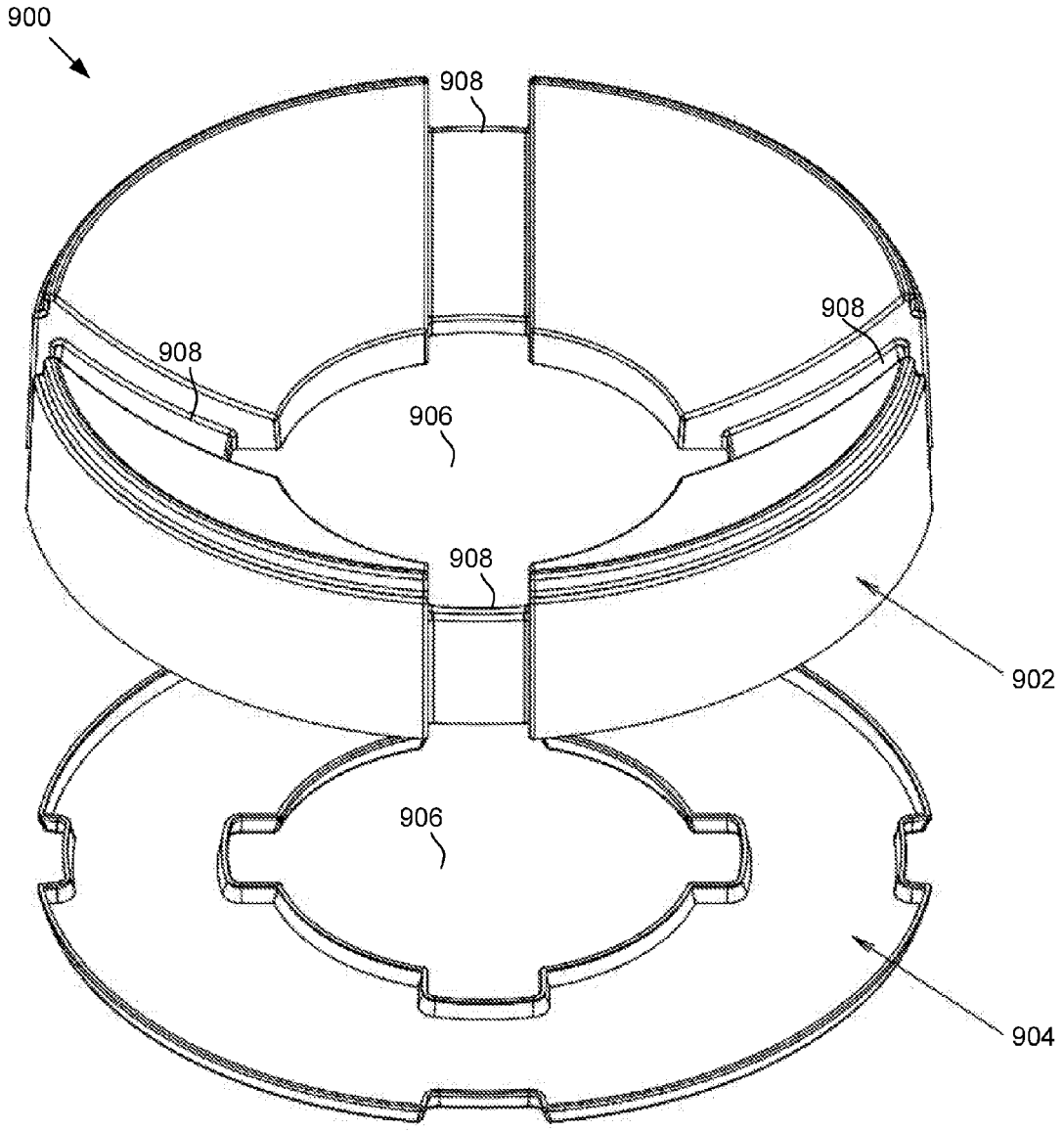
FIG. 13 is a schematic side view of a removable exercise ball retainer for a bodyweight exercise apparatus, according to one embodiment.

FIG. 13 depicts one embodiment of a removable exercise ball retainer 900 for a bodyweight exercise apparatus. In the depicted embodiment, the removable exercise ball retainer 900 comprises an upper retainer body 902 and a retainer base 904, each of which comprise an exercise ball opening 906, sized and configured to receive an exercise ball 150. An upper surface of the upper retainer body 902 is sloped and rounded toward the exercise ball opening 906 to approximate the shape of an exercise ball 150. The upper surface of the upper retainer body 902, in the depicted embodiment, includes one or more channels 908, which may allow air to pass between the exercise ball 150 and the exercise ball retainer 900, to prevent a suction effect from coupling the exercise ball 150 to the exercise ball retainer 900, may mechanically strengthen the exercise ball retainer 900, or the like. In one embodiment, the retainer base 904 may comprise one or more magnets, pins, and/or other attachment mechanisms to removably couple the exercise ball retainer 900 to a support base 140.

Figure 14:
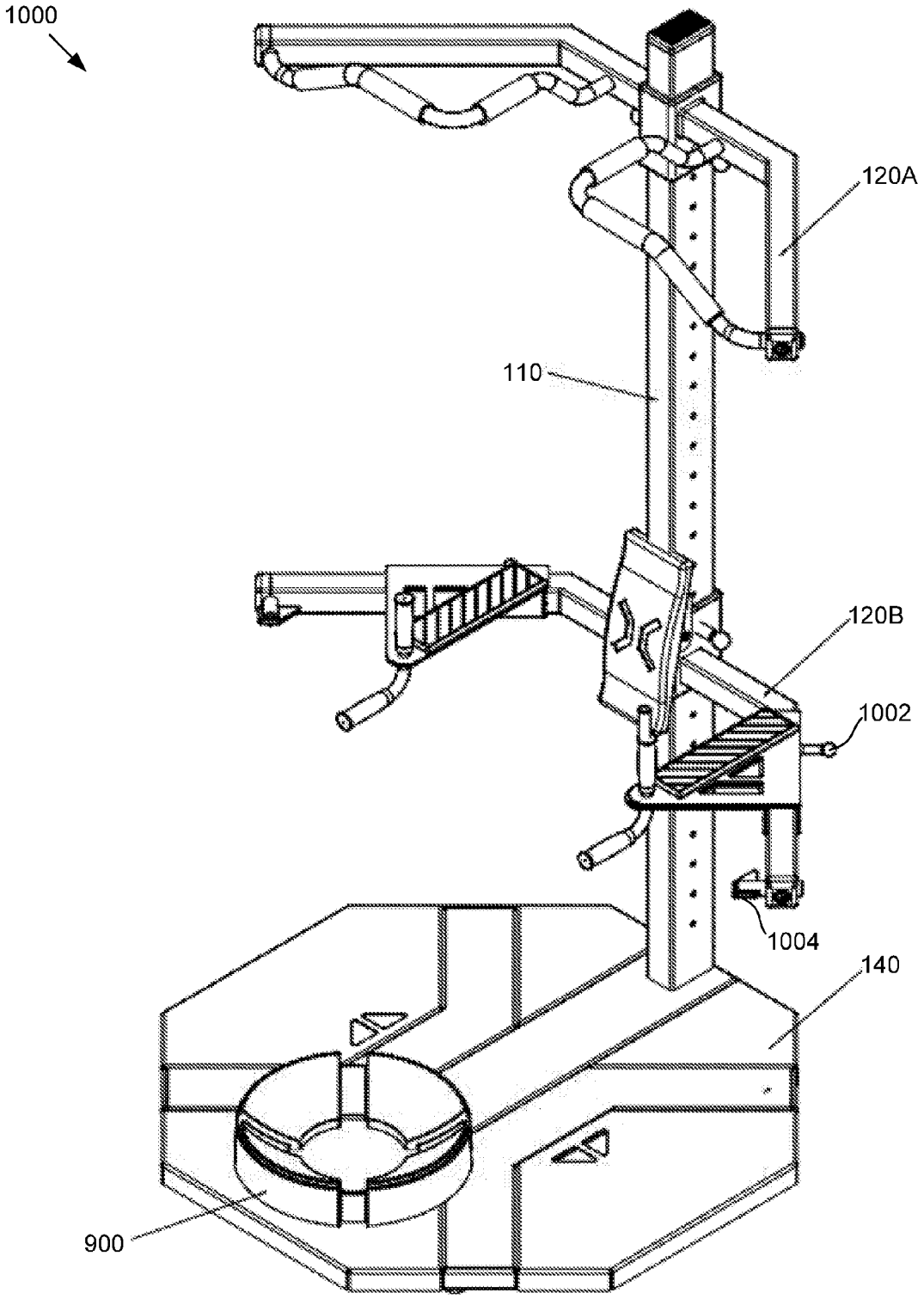
FIG. 14 is a schematic side view of a bodyweight exercise apparatus with a removable exercise ball retainer, according to one embodiment.

FIG. 14 depicts one embodiment of a bodyweight exercise apparatus 1000 with a removable exercise ball retainer 900. The removable exercise ball retainer 900, in the depicted embodiment, is removably coupled to the support base 140, by one or more magnets, pins, friction, or the like.

The exercise apparatus 1000, in the depicted embodiment, comprises an upper handle 120A and a lower handle 120B, each of which are adjustable and movable along a height of the tower assembly 110. The lower handle 120B, in the depicted embodiment, comprises one or more pins 1002, 1004 or other removable attachment mechanisms, allowing one or more handle extensions to be moved (e.g., to slide) along a length of the lower handle 120B, to be removed from the lower handle 120B, to be rotated into a different position (e.g., directed upward parallel to the tower assembly 110, directed downward parallel to the tower assembly 110, directed forward perpendicular to the tower assembly 110, directed backward perpendicular to the tower assembly 110, and/or another predefined angle relative to the tower assembly 110), or the like.

For example, in certain embodiments, a user 150 may pull and/or remove a first pin 1002 to slide or otherwise move the handle assembly along a length of the lower handle 120B and may remove a second pin 1004 in order to remove the handle assembly from the lower handle 120B, rotate the handle assembly, and replace it on the lower handle 120B with a different orientation, or the like.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus comprising:

a tower assembly;

at least one handle coupleable to the tower assembly, wherein a user may grasp the at least one handle to perform one or more bodyweight exercises, the at least one handle comprising an upper set of handles comprising a pull-up unit and a lower set of handles comprising a dip unit, the upper set of handles comprising an upper support arm extending outward horizontally from the tower assembly in two extension directions and a first set of hand-grips directly coupled to the upper support arm, the lower set of handles comprising a lower support arm extending outward horizontally from the tower assembly in the two extension directions and a second set of hand-grips directly coupled to the lower support arm, wherein an angle between the two extension directions is less than or equal to 90 degrees; and an exercise ball retainer configured to receive an exercise ball in roll-inhibiting engagement and configured to support the exercise ball in a spotting position relative to the at least one handle, wherein the exercise ball in the spotting position facilitates performance of the one or more bodyweight exercises.

2. The apparatus of claim 1, wherein the upper support arm and the lower support arm are adjustably coupleable to the tower assembly.

3. The apparatus of claim 2, wherein vertical positions of the upper support arm and the lower support arm are adjustable.

4. The apparatus of claim 2, wherein a lateral spacing between the second set of hand-grips is adjustable.

5. The apparatus of claim 1, wherein the exercise ball retainer is configured to support the exercise ball in a plurality of spotting positions.

6. The apparatus of claim 5, wherein the plurality of spotting positions are predetermined positions.

7. The apparatus of claim 1, further comprising a support base, wherein the tower assembly is coupleable to the support base.

8. The apparatus of claim 7, wherein the exercise ball retainer is removably coupleable to the support base.

9. The apparatus of claim 8, wherein the exercise ball retainer comprises magnets that are configured to magnetically couple the exercise ball retainer to the support base.

10. The apparatus of claim 7, wherein the exercise ball retainer is integrally formed in the support base.

11. The apparatus of claim 10, wherein the exercise ball retainer is an indentation recess formed in the support base.

12. The apparatus of claim 7, further comprising a step platform removably couplable to the tower assembly at any one of multiple heights along the tower assembly.

13. The apparatus of claim 1, wherein the tower assembly comprises a single column.

14. The apparatus of claim 13, wherein the tower assembly is configured to be positionable adjacent to an acute corner of a room.

15. The apparatus of claim 1, wherein at least one of the upper set of handles and the lower set of handles is detachable from the tower assembly.

16. A system comprising:

a support base;

a tower assembly coupleable to the support base;

at least one handle coupleable to the tower assembly, wherein a user may grasp the at least one handle to perform one or more bodyweight exercises, the at least one handle comprising an upper set of handles comprising a pull-up unit and a lower set of handles comprising a dip unit, the upper set of handles comprising an upper support arm extending outward horizontally from the tower assembly in two extension directions and a first set of hand-grips directly coupled to the upper support arm, the lower set of handles comprising a lower support arm extending outward horizontally from the tower assembly in the two extension directions and a second set of hand-grips directly coupled to the lower support arm, wherein an angle between the two extension directions is less than or equal to 90 degrees; and an exercise ball positionable relative to the at least one handle in a spotting position, wherein the exercise ball facilitates performance of the one or more bodyweight exercises.

17. The system of claim 16, further comprising an exercise ball retainer, wherein the exercise ball retainer is configured to support the exercise ball in roll-inhibiting engagement.

18. An apparatus comprising:

a support base;

a tower assembly coupleable to the support base;

at least one handle coupleable to the tower assembly, wherein a user may grasp the at least one handle to perform one or more bodyweight exercises, the at least one handle comprising an upper set of handles comprising a pull-up unit and a lower set of handles comprising a dip unit, the upper set of handles comprising an upper support arm extending outward horizontally from the tower assembly in two extension directions and a first set of hand-grips directly coupled to the upper support arm, the lower set of handles comprising a lower support arm extending outward horizontally from the tower assembly in the two extension directions and a second set of hand-grips directly coupled to the lower support arm, wherein an angle between the two extension directions is less than or equal to 90 degrees; and an exercise ball retainer coupleable to the support base, wherein the exercise ball retainer is configured to receive an exercise ball in roll-inhibiting engagement and configured to support the exercise ball in a spotting position relative to the at least one handle, wherein the exercise ball in the spotting position facilitates performance of the one or more bodyweight exercises.

19. The apparatus of claim 18, further comprising the exercise ball.

* * * * *